US006582244B2

(12) United States Patent
Fogg et al.

(10) Patent No.: US 6,582,244 B2
(45) Date of Patent: Jun. 24, 2003

(54) CONNECTOR INTERFACE AND RETENTION SYSTEM FOR HIGH-DENSITY CONNECTOR

(75) Inventors: Michael W Fogg, Harrisburg, PA (US); David M Wiebking, Kernersville, NC (US); Randy G Simmons, Winston-Salem, NC (US); Kurt T Zarbock, Advance, NC (US); Kevin J Peterson, High Point, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/060,006

(22) Filed: Jan. 29, 2002

(65) Prior Publication Data

US 2002/0146926 A1 Oct. 10, 2002

Related U.S. Application Data

(60) Provisional application No. 60/264,761, filed on Jan. 29, 2001.

(51) Int. Cl.[7] ..... H01R 13/627

(52) U.S. Cl. ..... 439/362; 439/677

(58) Field of Search ..... 439/362, 365, 439/607, 677, 378, 564, 680; D13/147

(56) References Cited

U.S. PATENT DOCUMENTS

| | | | | | |
|---|---|---|---|---|---|
| 4,453,797 | A | * | 6/1984 | Hollingsead et al. | 248/27.1 |
| 4,647,130 | A | * | 3/1987 | Blair et al. | 439/248 |
| 4,767,350 | A | * | 8/1988 | Cooper et al. | 439/271 |
| 5,066,236 | A | | 11/1991 | Broeksteeg | 439/79 |
| 5,295,871 | A | * | 3/1994 | Lapraik et al. | 439/746 |
| 5,567,168 | A | | 10/1996 | Marsh et al. | 439/181 |
| 5,567,169 | A | | 10/1996 | McCleerey et al. | 439/181 |
| 5,637,019 | A | | 6/1997 | Crane, Jr. et al. | 439/677 |
| 6,120,332 | A | | 9/2000 | Bertens et al. | 439/701 |
| 6,135,815 | A | * | 10/2000 | Ko et al. | 439/607 |

FOREIGN PATENT DOCUMENTS

| | | | |
|---|---|---|---|
| EP | EP 0 649 191 A1 | 4/1995 | H01R/13/658 |

* cited by examiner

*Primary Examiner*—Neil Abrams
*Assistant Examiner*—Phuong K T Dinh
(74) *Attorney, Agent, or Firm*—Baker & Daniels

(57) ABSTRACT

A plug and receptacle assembly comprises a plug connector and receptacle connector, for high-density interconnections of data cable. The two connectors are fully shielded and include a mating profile including a modified D-shaped configuration where one end of the shroud includes a concave radiused portion and two jackscrews or threaded inserts are located within the area formed by the concave radiused portion. In this manner, the entire width of the connector assembly is reduced for high-density interconnections.

20 Claims, 9 Drawing Sheets

CONNECTOR INTERFACE AND RETENTION SYSTEM FOR HIGH-DENSITY CONNECTOR

This application claims the benefit of U.S. Provisional Patent Application Serial No. 60/264,761 filed Jan. 29, 2001, the complete disclosure of which is hereby expressly incorporated by reference.

BACKGROUND OF THE INVENTION

1. Field of the Invention

The invention relates to an electrical connector system for high-density interconnection of data cables and the like, and in particular, to an improved mating connection for such high-density electrical connectors.

2. Summary of the Prior Art

It is common in building wiring closets where hubs and routers are located for distribution and/or storage of data, to have a plurality of racks and panels with multiple electrical interconnections formed by multiple cables. It is commonplace to have such electrical connections made by connection systems commonly known as modular plugs and jacks, the so-called RJ-45 connection system, or other systems such as the RJ-21. Separate connection systems have traditionally been used, due to the speed of the data, the need to minimize EMI radiation, as well as the need to minimize cross talk between adjacent lines in the same connector.

One electrical connection system useful with data interconnections as described above is shown in U.S. Pat. No. 5,066,236 to Broeksteeg. Such an electrical connector system is modular in nature incorporating a plurality of side-by-side printed circuit board mountable connector housings having a plurality of contact arrays insert molded in a web of insulating material to include contact portions which extend into the housings and are positionable adjacent to a mating face, and a printed circuit board contact portion for mounting to a printed circuit board. While the Broeksteeg design is an excellent concept, he was not concerned with a mating interface to hubs, routers and servers or the like. Rather, what is desired is to have a standard I/O configuration for such electrical connections, yet having increased electrical characteristics with a high-density packaging.

One interface known in the art is the D-shaped interface, for example, as shown in U.S. Pat. No. 5,567,169. Such an interface includes a shielding shroud encircling the electrical connections thereby forming a continuous line ground between the cables of the connection. The configuration of the shielding shroud is defined by upper and lower elongate shielding walls extending forwardly from the connector, and two oppositely angled end walls which form a substantially trapezoidal shape. While the trapezoidal shape provides a polarizing feature, that is, prevents mismating about the axial line, it widens the profile in side-to-side spacing between adjacent connectors. That is, the jackscrews and corresponding openings must be wide enough to clear the end walls of the shroud.

The objects of the invention are to improve upon the shortcomings as mentioned above.

SUMMARY OF THE INVENTION

The objects of the invention have been accomplished by providing an electrical connector having a housing body and a plurality of electrical contacts. The connector further comprises a front shroud portion extending forwardly from a front face of said connector and has a general parallelogram configuration, the shroud including upper and lower substantially parallel walls extending transverse to the front face and opposite end walls completing the shroud. The connector also includes fastener members located adjacent to diametrically opposed obtuse corners of the shroud.

In the preferred embodiment of the invention, the electrical connector further comprises a plurality of rows of electrical contacts, the rows being generally staggered to conform within the front shroud portion. Preferably, there are four rows of contacts, with two rows being staggered relative to the other rows.

Preferably, one of the end walls extends diagonally between the upper and lower walls, and the opposite wall is discontinuous and has a concave radiused portion. The electrical connector includes a first fastener member positioned adjacent to the mating face and at least partially beneath the diagonal wall. The electrical connector also includes a second fastener member positioned adjacent to the concave radiused portion.

In the preferred embodiment of the invention, the shroud is a shielding member.

In another aspect of the invention, an electrical connector has a housing body and a plurality of electrical contacts, and further comprises a front shroud portion extending forwardly from a front face of the connector. The shroud has a generally parallelogram configuration, including upper and lower substantially parallel walls extending transverse to the front face and opposite end walls completing the shroud, and a plurality of rows of electrical contacts, the rows being generally staggered to conform within the front shroud portion.

In the preferred version of this connector, the electrical connector further comprises fastener members located adjacent to diametrically opposed obtuse corners of the shroud.

Preferably, the electrical connector comprises four rows of contacts, with two rows being staggered relative to the other rows.

Also preferably, one of the end walls of the shroud extends diagonally between the upper and lower walls, and the opposite wall is discontinuous and has a concave radiused portion. In this version of the electrical connector, a first fastener member is positioned adjacent to the mating face and at least partially beneath the diagonal wall. A second fastener member is positioned adjacent to the concave radiused portion.

The electrical connector shroud is preferably a shielding member.

In yet another embodiment of the invention, an electrical connector has a housing body and a plurality of electrical contacts, the connector further comprising a front shroud portion extending forwardly from a front face of the connector. The shroud includes an upper and lower elongate wall extending transverse to the front face and a diagonal wall extending between the upper and lower walls. A fastener member is positioned adjacent to the mating face and at least partially beneath the diagonal wall. A discontinuous wall opposite the diagonal wall has a concave radiused portion with a second fastener member positioned adjacent to the concave radiused portion.

In the preferred embodiment of the invention, the electrical connector further comprises a plurality of rows of electrical contacts, the rows being generally staggered to conform within the front shroud portion. The electrical connector comprises four rows of contacts, with two rows being staggered relative to the other rows.

Preferably, the shroud is a shielding member.

The electrical connector can be profiled as either a plug connector or a receptacle connector. When configured as a plug connector, the connector is profiled for interconnection to twisted pair conductors of a multi-conductor cable. When configured as a receptacle connector, it is complementary with the plug connector to form a mating connection assembly. The receptacle connector has a complementary shielding shroud to the plug connector, and complementary first and second fastener members.

DETAILED DESCRIPTION OF THE PREFERRED EMBODIMENT

Figure 1:
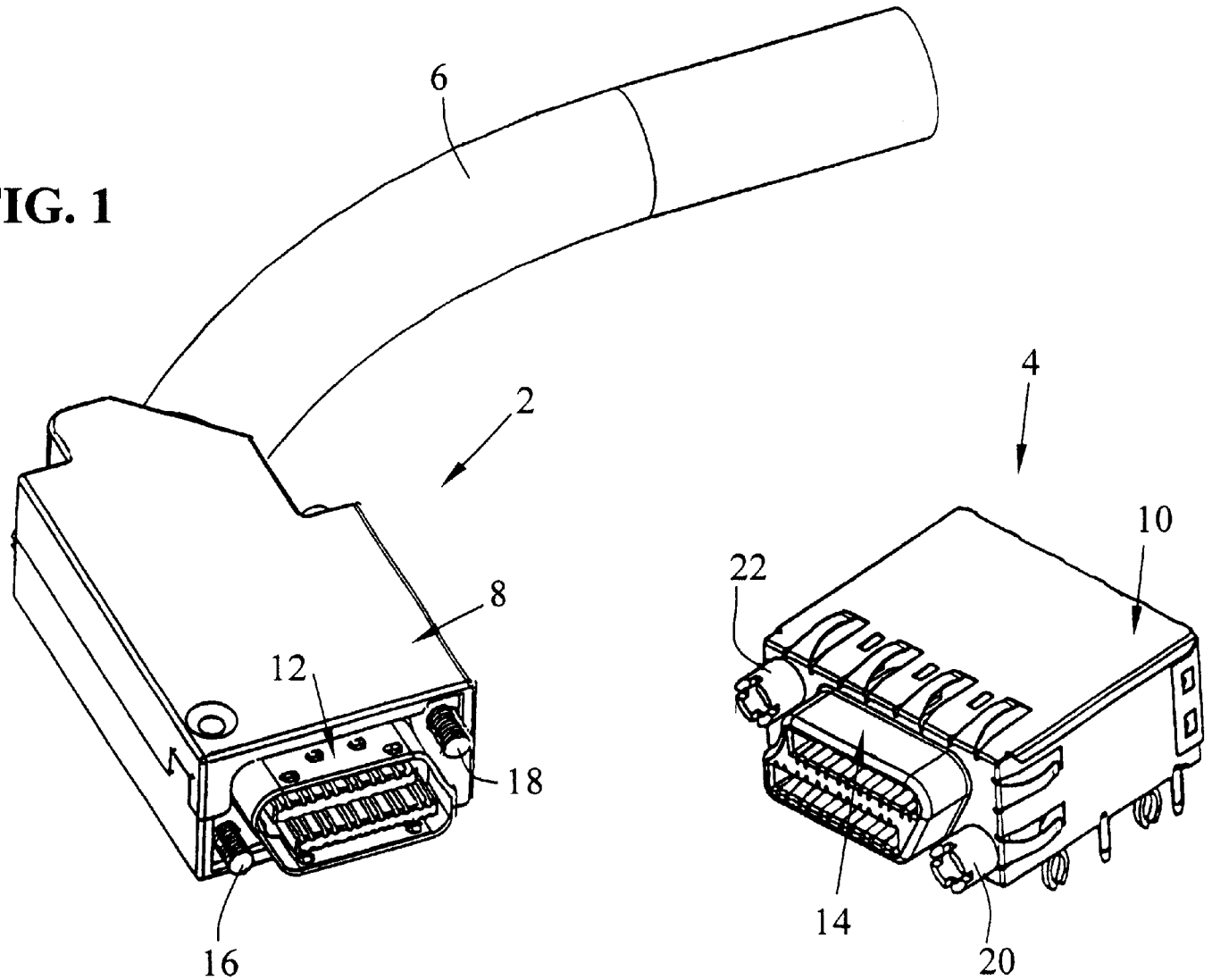
FIG. 1 shows a perspective view showing the plug connector and receptacle connector poised for interconnection.

With respect first to FIG. 1, an electrical interconnection is shown as comprised of a plug connector 2 and a receptacle connector 4. The plug connector 2 is adapted to be connected to a shielded cable 6 which preferably contains a plurality of twisted pair conductors, whereas receptacle 4 is adapted to be connected to a printed circuit board (not shown). Both electrical connectors are fully shielded where the plug connector 2 includes a shielded enclosure 8 which is preferably a die-cast housing of two similar halves, whereas receptacle 4 includes a shield 10 which in the preferred embodiment is a stamped metallic housing.

Each electrical connector also includes a mating interface comprised of a shielding shroud, plug connector 2 having a shielding shroud shown generally at 12 which is profiled to receive in shielding engagement, the shielding shroud 14 of receptacle 4. Finally, plug connector 2 includes elongate jackscrews 16 and 18 which are profiled for threaded engagement with complementary threaded posts 20 and 22, respectively, of the receptacle 4. It should be appreciated that, when the jackscrews 16, 18 are fully threaded into their respective threaded posts 20, 22, the two electrical connectors 2, 4 are in a fully mated condition where electrical terminals within plug connector 2 are fully electrically engaged with electrical terminals in receptacle 4, as will be described in greater detail herein.

Figure 2:
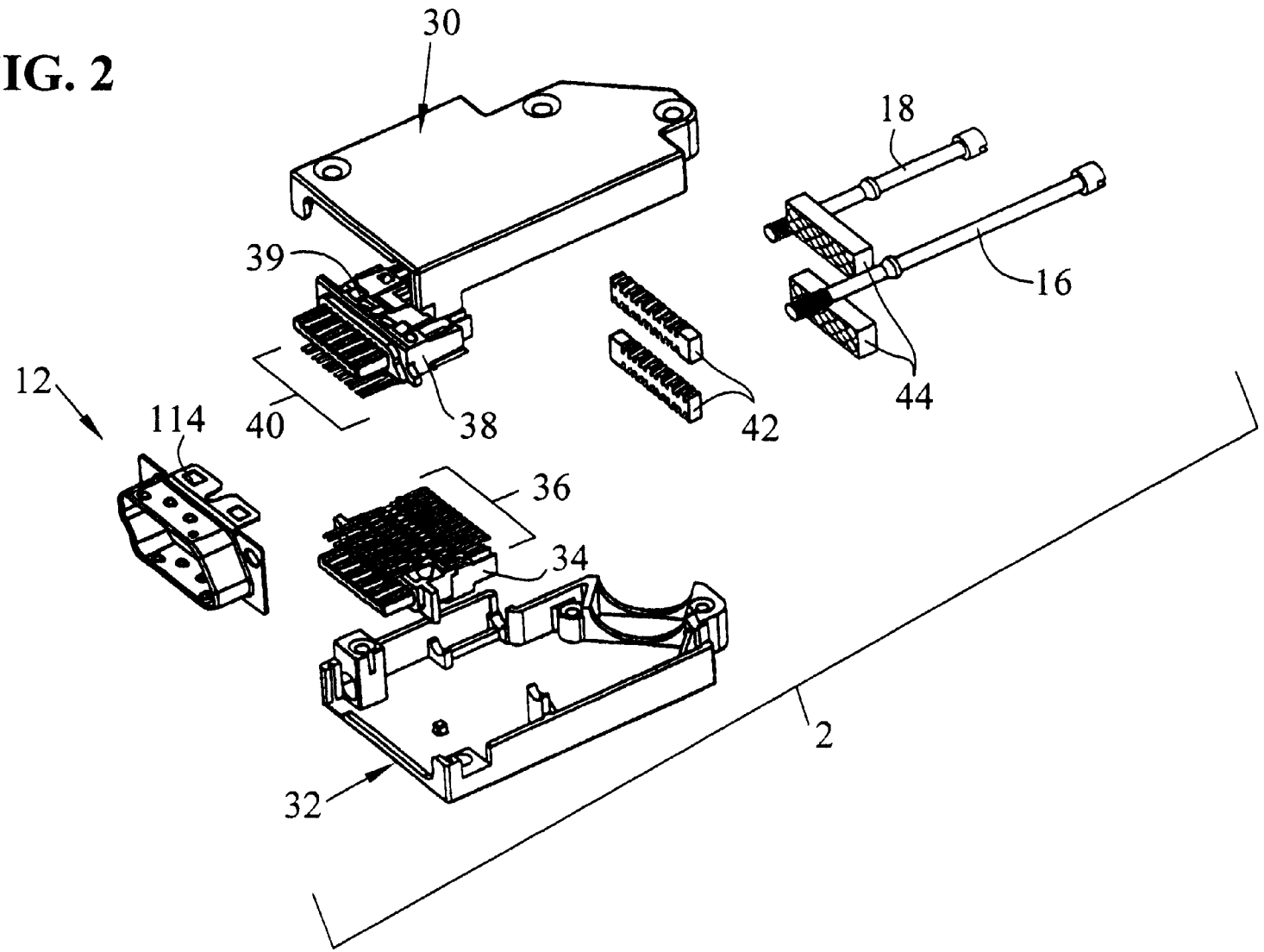
FIG. 2 shows an exploded perspective view of the plug connector of FIG. 1.

With respect now to FIG. 2, the plug connector 2 is shown in an exploded manner for better clarity. While the plug connector will be described in further detail, the plug connector is described even more fully in co-pending patent application filed on even date as Ser. No. 60/264,763, (attorney's docket number 17629), incorporated herein by reference. It should be appreciated that the shielding shell 8 as shown in FIG. 1 is comprised of bi-partite halves 30 and 32. The plug connector 2 further comprises housing portion 34 carrying a plurality of electrical terminals 36 and an electrical connector housing portion 38 carrying a plurality of electrical terminals 40. The plug connector 2 further includes a pair of wire organizing blocks at 42 to arrange the twisted pairs in alignment with the terminals and a pair of wire dressing blocks 44.

Figures 3, 4:
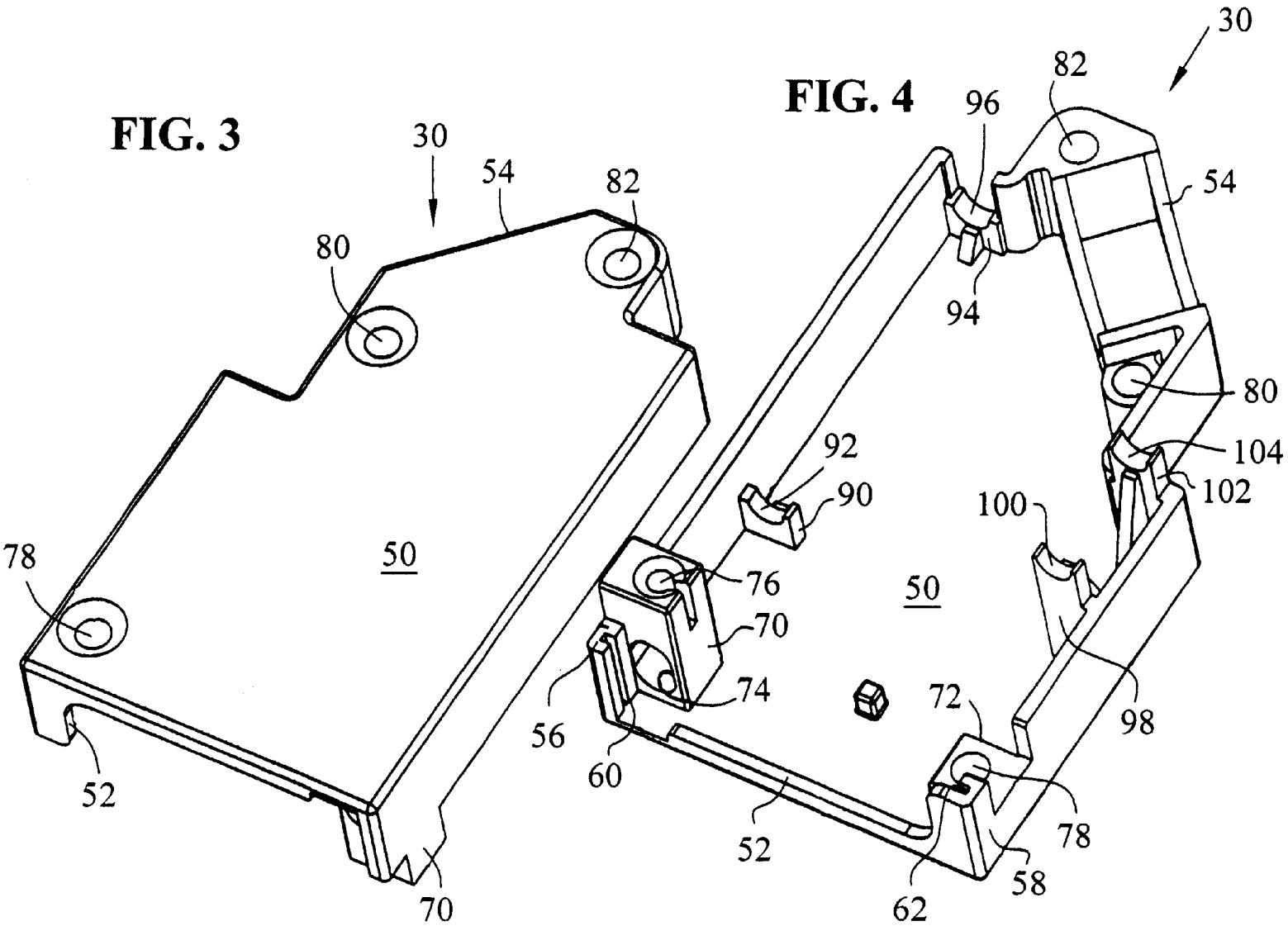
FIG. 3 shows a top view of a first shield shell for the plug connector.
FIG. 4 shows the underside of the shield shell of FIG. 3.

With respect now to FIGS. 3 and 4, the shielding shells 30, 32 will be described in greater detail. It should be appreciated that both FIGS. 3 and 4 depict shielding shell 30, but that shielding shell 32 would be identical, with the exception of the cable entry opening orientation, as will be described. As shown best in FIGS. 3 and 4, shielding shell 30 is comprised of a generally flat wall portion 50 having a front opening portion at 52 and a rear cable-receiving portion at 54. As shown in FIG. 4, the shielding shell 30 includes upstanding wall portions 56, 58 having vertically oriented slots at 60, 62 for placement of the shielding shroud as will be described herein.

As shown in FIG. 4, shielding shell 30 further includes complementary mounting blocks 70, 72 where mounting block 70 includes a horizontally disposed through-hole 74 and a vertically disposed mounting aperture at 76. Meanwhile, mounting block 72 includes a through-hole at 78 which will align with a mounting hole in the opposite shielding shell when the two shielding shells are placed together. The cable-receiving opening at 54 further includes openings at 80 and 82 which will also align with openings in the opposite shielding shell 32 when aligned. Finally, the shielding shell 30 includes a jackscrew support at 90 having a U-shaped section 92, and a support member 94 having a U-shaped section 96. On the opposite side, a jackscrew support is shown at 98 having a U-shaped section at 100, whereas a support 102 has a U-shaped section at 104.

Figure 5:
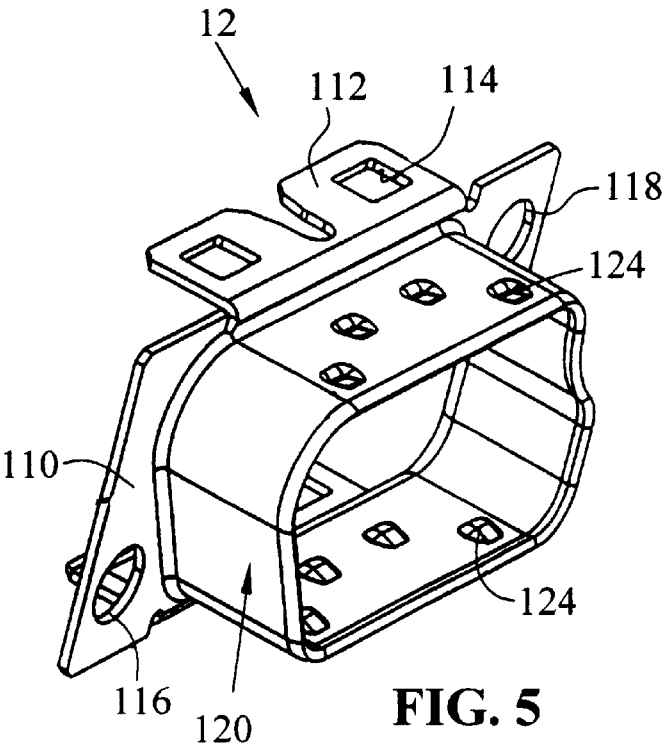
FIG. 5 shows the shield shroud of the plug connector of FIG. 1.
Figure 6:
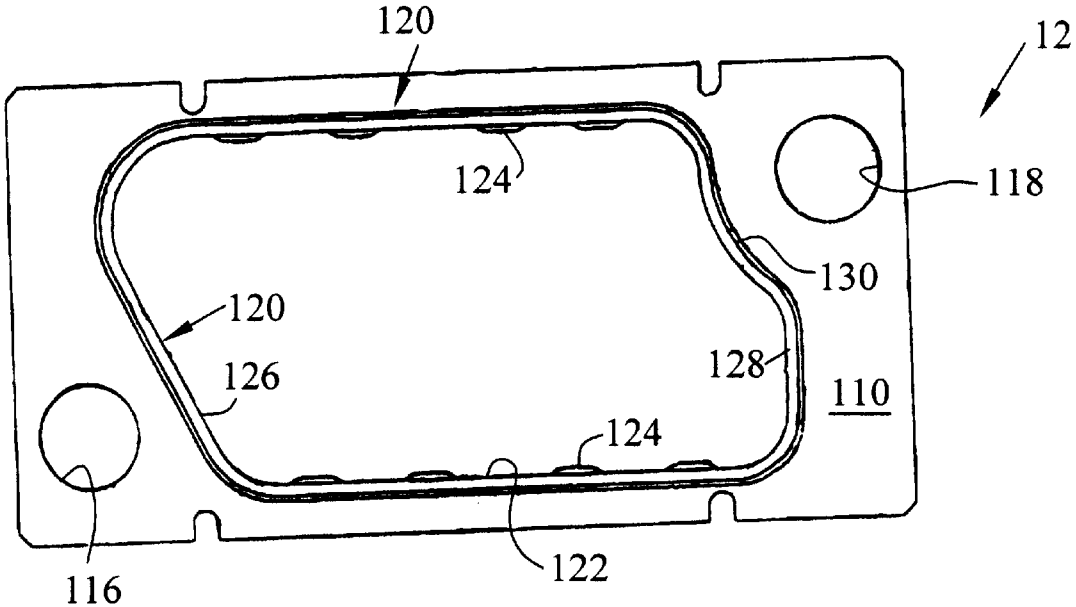
FIG. 6 is a front plan view of the shielding shroud shown in FIG. 5.
Figure 7:
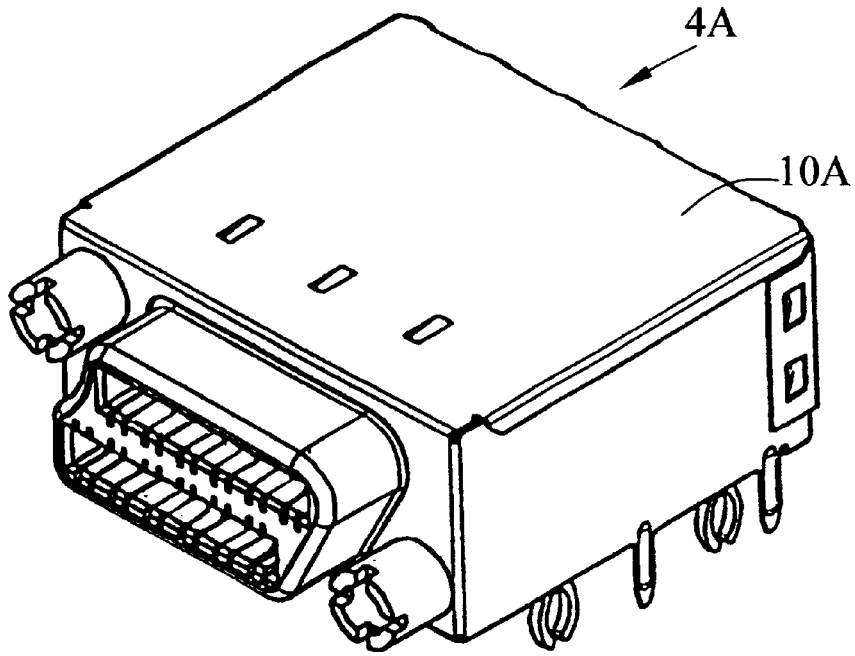
FIGS. 7 and 8 show perspective views of alternative receptacles for use with the plug connector of FIG. 1.
Figure 8:
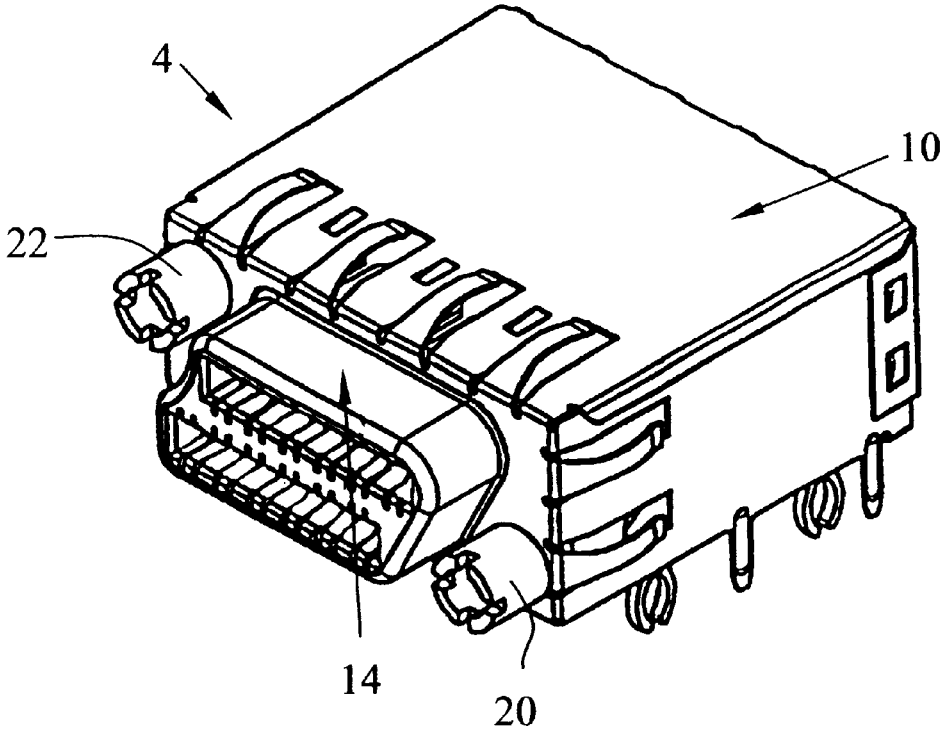

With respect now to FIG. 5, the shielding shroud 12 is shown as including a base wall 110 having latch sections 112 extending therefrom having latching openings at 114. The base wall 110 further includes diametrically opposed openings at 116, 118. The shroud 12 further includes a peripheral shroud portion 120 which is a drawn shroud portion extending forwardly from the base wall 110. As shown in FIG. 6, the shroud section 120 includes a top shroud wall 120, a lower shroud wall 122, which is generally disposed parallel to upper wall 120, where each of the walls includes stamped projections at 124 acting as shielding contacts as is well known in the art. As shown in FIG. 6, end wall 126 forms an obtuse angle relative to lower wall 122 and an acute angle with respect to 120. On the opposite side of the shroud, a generally vertical upstanding wall portion is shown at 128 which is continuous with a concave radiused portion at 130. It should also be appreciated from FIG. 6 that apertures 116 and 118 are diametrically opposed in opposite corners of the base wall 110 where aperture 116 is positioned so as to be partially extending beneath wall portion 126, with aperture 118 extending adjacent the concave radiused portion 130. It should be appreciated that the concave radiused portion 130 provides enough room in the corner of the base wall to provide the aperture 118. It should also be appreciated from viewing FIG. 6 that the configuration of the shroud is of general parallelogram configuration.

With respect now to FIGS. 7 through 11, the receptacle 4 will be described in greater detail. As shown first with respect to FIGS. 7 and 8, the receptacle can take numerous configurations, as shown by receptacles 4 and 4A comprising alternative shields 10 and 10A, respectively. The receptacles 4 and 4A are more completely described in applicants' co-pending patent application filed on even date as Ser. No. 64/264,760 (attorney's docket 17630), incorporated herein by reference.

Figure 9:
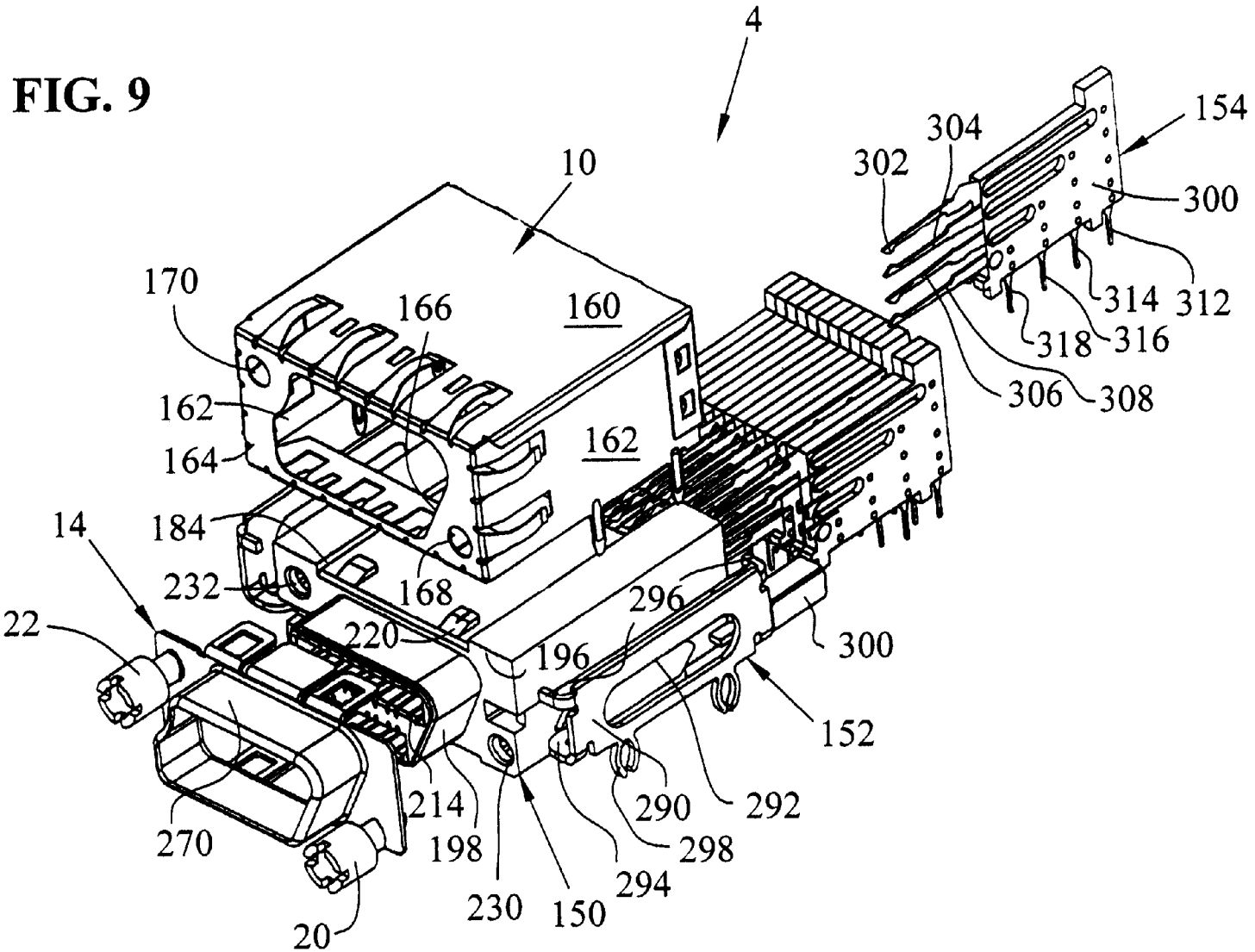
FIG. 9 shows an exploded view of the plug connector of FIG. 8.

With respect now to FIG. 9, the receptacle 4 is generally comprised of the outer shield member 10, the front shielding shroud 14, an inner housing 150, boardlock members 152, and a plurality of terminal lead frame assemblies shown best at 154. As shown in FIG. 9, the shielding member 10 is generally comprised of an upper wall portion 160, side wall portions 162, and a front wall portion 164. The front wall portion 164 includes an opening 166 profiled to receive the connector and shielding shroud 14 therethrough, together with through-holes 168 and 170 for receiving jackbolts 20 and 22, respectively.

Figure 10:
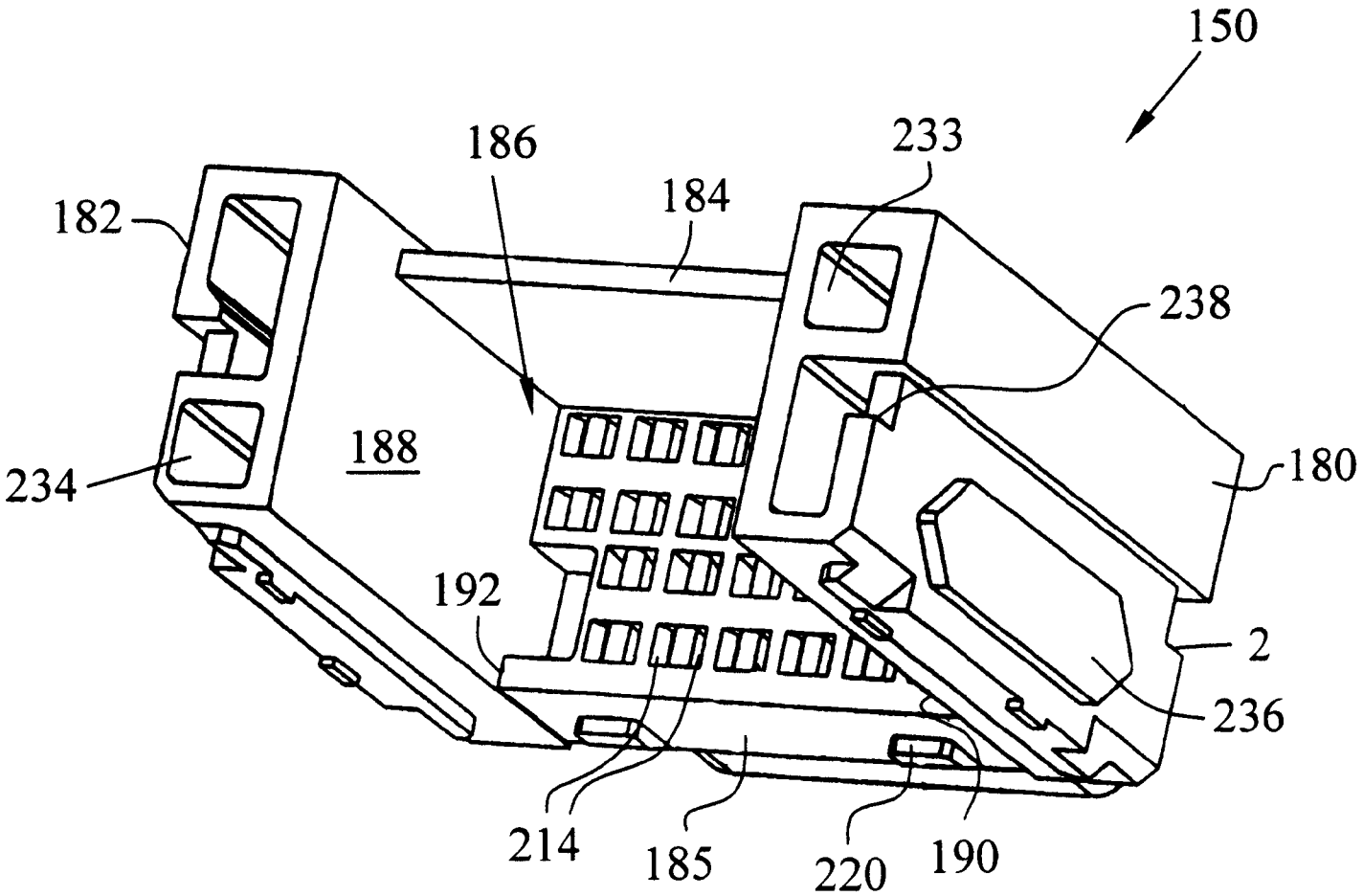
FIG. 10 is a rear perspective view of the receptacle housing.
Figure 13:
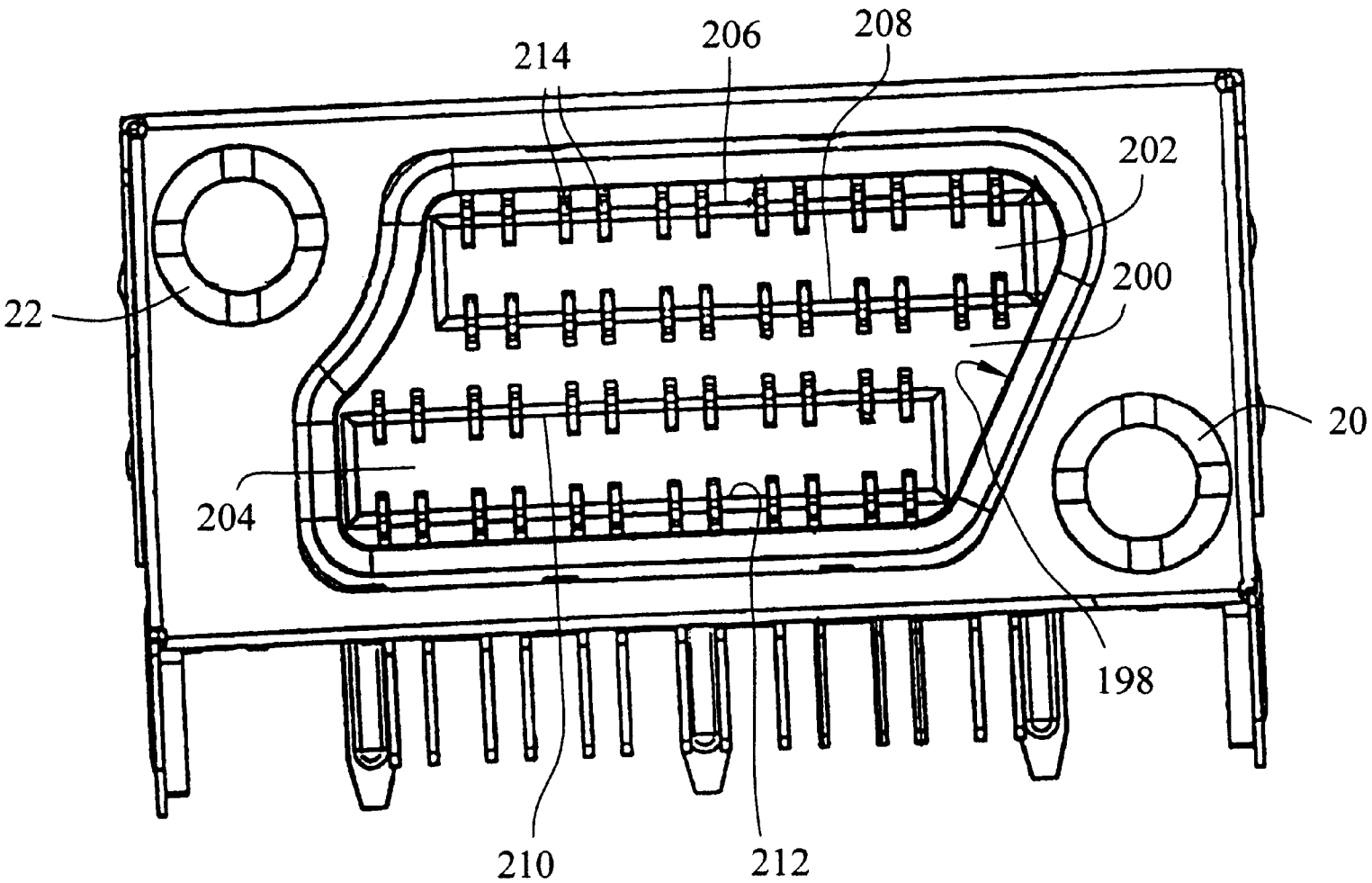
FIG. 13 shows a front plan view of the connector of FIG. 8.

With respect now to FIG. 10, the housing 150 will be described in greater detail. Housing 150 generally includes side walls 180 and 182 with an intermediate top wall 184. The side walls 180, 182, and top wall 184 together form a contact receiving area 186 intermediate side surfaces 188, 190, and rearward of rear face 192. As shown in FIG. 9, the housing 150 further includes a front face 196 having an integrally molded shroud portion 198 extending forwardly therefrom having a front face 200. The shroud member 198 includes two rectangular recesses shown at 202 and 204 (FIG. 13) which extend rearwardly to rear wall 192 (FIG. 10). As shown in FIG. 13, the openings 202 and 204 form therein upper and lower surfaces, for example, upper surface 206 and surface 208 of opening 202, and upper surface 210 and lower surface 212 of opening 204. Also, side-by-side terminal receiving slots 214 extend through the rear wall 192 and partially into surfaces 206, 208, 210, 212 as best shown in FIGS. 9, 10 and 13.

Finally, housing 150 further includes latching projections 220 extending from top wall 184 (FIG. 9) as well as latching projection 220 extending from lower wall 185 (FIG. 10). Housing member 150 also includes an aperture 230 and 232, which open up into square cavities 233, 234 (FIG. 10), as further described herein. The housing 150 also includes an elongate projection 236 and two recesses 238 to receive the boardlock mechanism 152.

Figure 11:
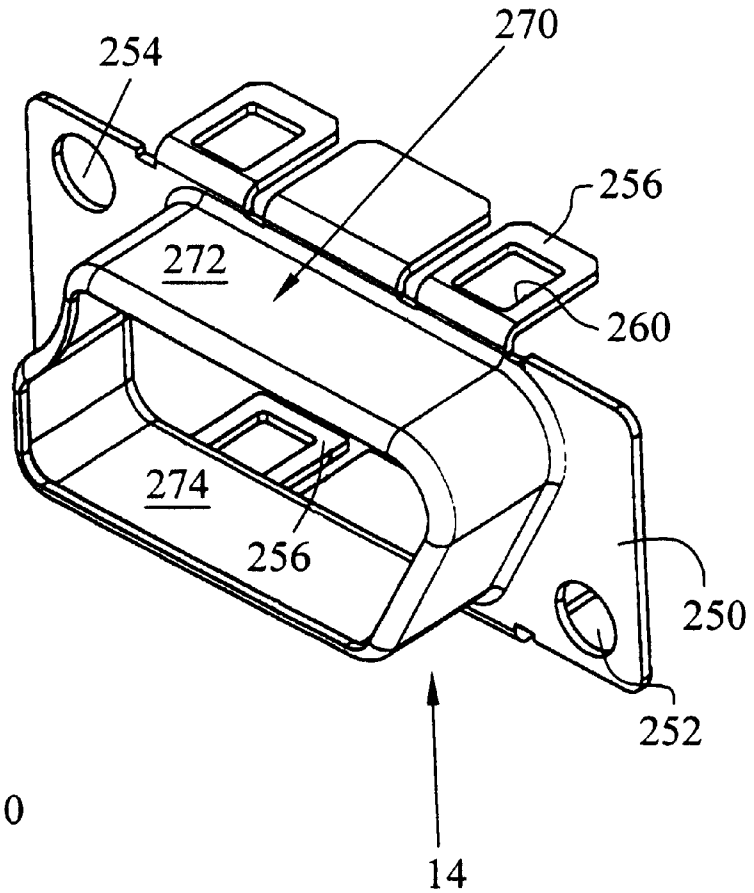
FIG. 11 is a perspective view of the receptacle shielding shroud.
Figure 12:
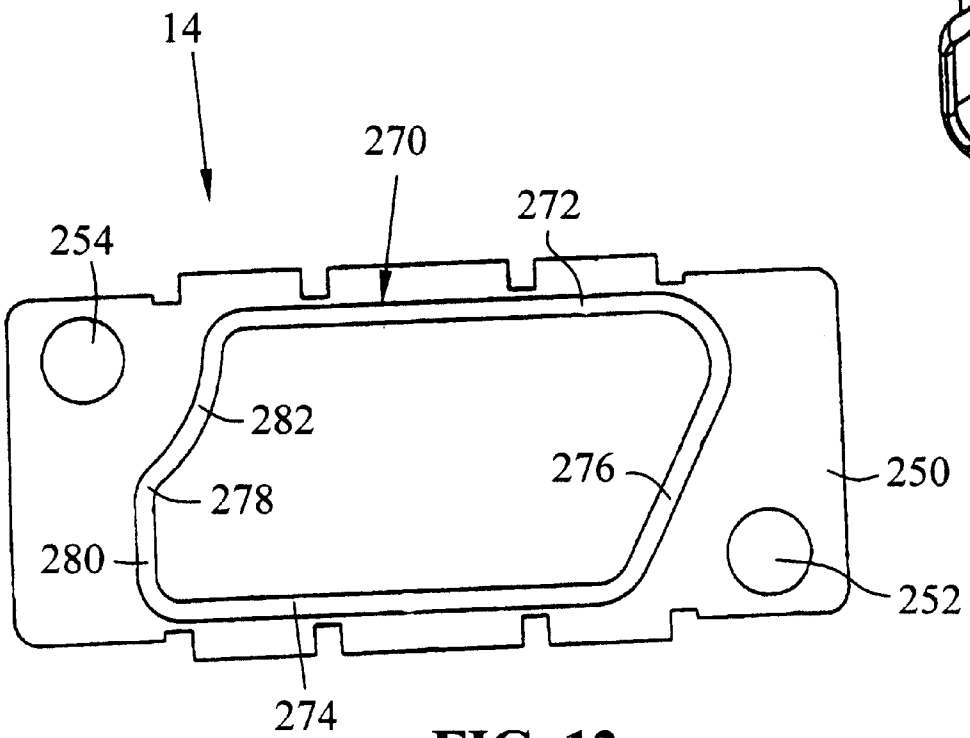
FIG. 12 is a front plan view of the shielding shroud of FIG. 11.

As shown best in FIGS. 11 and 12, shroud 14 generally includes a front wall portion 250 having apertures 252 and 254 extending therethrough. Latching ears 256 extend from top and lower edges of the wall 250 and include latching apertures 260. A drawn shroud portion 270 extends integrally from the wall portion 250 and is complementary to the shielding shroud 120 of the plug connector which was described in FIG. 5. Shroud portion 270 includes top and bottom wall portions 272 and 274 and side wall portions 276 and 278. Side wall portion 276 is angled upwardly and outwardly so as to define an obtuse angle relative to lower wall 274 and an acute angle relative to top wall 272. Side wall 278 includes a portion 280 extending generally vertical relative to lower wall 274 and a concave radiused portion 282 which extends between side wall portion 280 and upper wall portion 272. It should be appreciated that the shroud portion 270 is profiled to interferingly fit within shroud portion 120.

With reference to FIG. 9, the boardlock member 152 generally includes a plate section 290 having an elongate opening at 292, and a folded-over lower wall 294. Tabs 296 extend from opposite ends of the plate portion, while compliant boardlock portions 298 extend from a lower edge of the plate portion 290.

With respect again to FIG. 9, the terminal assembly 154 generally includes a lead-frame portion which is stamped and formed from a highly conductive material and overmolded with a web of insulating material, for example, at 300. The lead frame is stamped and formed so as to define four distinct contact portions, for example, mating contact portions 302, 304, 306, and 308, with corresponding printed circuit board contact portions 312, 314, 316, and 318.

With the plug and receptacle components as described above, the assembly of both the plug assembly 2 and receptacle assembly 4 will be described in greater detail.

With reference first to FIG. 2, the terminals 36 and 40 will be assembled to their respective connector housing portions 34, 38. It should be appreciated that two rows of terminals 36 will be positioned in housing 34, and two rows of terminals 40 will be positioned in housing 38. This positions an end portion of terminals 36 and 40 adjacent a rear portion of their respective housings for soldering to respective conductors of multiconductor cable 6 (FIG. 1). In the preferred embodiment, there are two rows of twelve terminals 36, and two rows of twelve terminals 40, or 48 terminals total, which will accommodate 24 twisted pair conductors. To assemble the conductors to the various terminals 36, 40, the twisted pairs, while still twisted, are inserted through apertures of wire organizing blocks 44 and then the wires separated and placed in individual slots of the dressing blocks 42. It should be appreciated that housing 34 and 38 are sandwiched together to form a housing assembly, therefore, the inside facing terminals are soldered first, and then the housing 34, 38 are sandwiched together whereupon the outer row of terminals 36, 40 receive their respective wires.

With the housing comprised of housing portions 34 and 38 assembled as described above, the shielding shroud 12 can be slidably received over the front portion thereof until the latching openings 114 latch with respective latch projections 39 (FIG. 2) on housing 38, and a respective latching projection (not shown) on housing 34. This latches the combination of the housing portions 34 and 38 to the shielding shroud 12. The shielding shroud can then be placed in the shielded portion 32 such that the side edges of the front wall portion 110 of the shielding shroud 12 are received in slots 60 and 62 of a corresponding shielded housing.

The jackbolts 16 and 18 are thereafter positioned in their respective positions, such that jackscrew 16 is positioned through a corresponding opening 74, and jackscrew 18 is positioned on corresponding platforms 100, 104. The top portion 30 can thereafter be positioned above shielded housing portion 32 and threaded fasteners can be positioned through openings 78, 80, 82 to fasten the two shield shells together. It should be appreciated that the cable 6 is dressed through the opening 54 and, in the preferred embodiment, would include a strain relief collar. As assembled, the housing portions 34, 38 are stacked one above the other in a laterally staggered configuration, as best shown in FIG. 1.

With respect now to FIG. 9, the assembly of the receptacle 4 will be described in greater detail. The shielding shroud 14 is connectable to the housing 150 by snapping the openings 260 (FIG. 11) over the latch projections 220 on the housing. Each of the terminal subassemblies 154 are also positionable into the terminal-receiving area 186 (FIG. 10) to position the contacts 302–308 into respective columns of terminal receiving slots 214 to position the terminals within the integral shroud 198 of the housing 150. The boardlock members 152 are then attached to the housing 150, with the tabs 296 (FIG. 9) positioned in slots 238, and with elongate slot 292 positioned over elongate projection 236. With the shielding shroud 14, terminal subassemblies, and boardlock 152 assembled to the housing 150, the assembly is completed by assembly of the shield 10 over the housing 150.

A square threaded insert 300 is positioned in respective square openings 233, 234 and the shielding member 10 is thereafter positioned over the housing 150 such that shield extension 270 extends through opening 166 of the shield 10. The threaded posts 20 and 22 can thereafter be positioned through openings 168, 170, through openings 252, 254 (FIG. 12), and thereafter through openings 230, 232 to be threadably connected with the square inserts 300. This retains the threaded posts 20, 22 to the front face of the receptacle for connection with the plug 2.

To connect the two connectors together, it should be appreciated that the shroud portion 270 is inserted within shroud portion 120 of shielding shroud 12. This positions the outer surface of the walls 272, 274, 276, and 278 within the periphery of shroud portion 120 (FIG. 5) and in contact therewith through embossed portions 124. It should be appreciated that, from comparing FIGS. 6 and 12, the profile of the shroud for each of the plug and receptacle are mirror images of each other such that, when the two connectors are mated, the concave radiused portion 282 resides within the concave radiused portion 130 of the plug connector. It should also be appreciated that this places the jackscrews 16, 18 in alignment with the threaded inserts 20 and 22 to pull the two connectors into complete engagement.

Advantageously, the design as described above has accomplished a compact high-density design of connector. Due to the fact that the shroud portions 120, 270 have diagonal wall portions 126, 276 on one side only, and include the concave radiused portions 130, 282 on the opposite sides, the apertures 116, 118; 252, 254 can be placed laterally closer than otherwise achieved. This is also due to the fact that the through holes are diametrically opposed relative to their respective shrouds 12, 14 allowing the through holes to be incorporated into the shrouds where material exists on the plate portions 110, 250.

What we claim is:

1. An electrical connector having a housing body and a plurality of electrical contacts, said connector further comprising a front shroud portion extending forwardly from a front face of said connector having a generally rhomboidal configuration with diametrically opposed obtuse corners, said shroud including upper and lower substantially parallel walls extending transverse to said front face and opposite end walls completing said shroud, and fastener members located adjacent to said diametrically opposed obtuse corners, said fastener members being profiled for attachment to a mating connector.

2. The electrical connector of claim 1, further comprising a plurality of rows of electrical contacts, said rows being generally staggered to conform within said front shroud portion.

3. The electrical connector of claim 2, comprising four rows of contacts, with two rows being staggered relative to the other rows.

4. The electrical connector of claim 1, wherein one of said end walls extends diagonally between the upper and lower walls, and the opposite wall is discontinuous and has a concave radiused portion.

5. The electrical connector of claim 4, wherein a first fastener member is positioned adjacent to said mating face and at least partially beneath said diagonal wall.

6. The electrical connector of claim 5, wherein a second fastener member is positioned adjacent to said concave radiused portion.

7. The electrical connector of claim 1, wherein said shroud is a shielding member.

8. An electrical connector having a housing body and a plurality of electrical contacts, said connector further comprising a front shroud portion extending forwardly from a front face of said connector having a general parallelogram configuration with diametrically opposed obtuse corners, said shroud including upper and lower substantially parallel walls extending transverse to said front face and opposite end walls completing said shroud portion, and a plurality of rows of electrical contacts, said rows being generally staggered to conform within said front shroud portion.

9. The electrical connector of claim 8, further comprising fastener members located adjacent to said diametrically opposed obtuse corners of said shroud portion, said fastener members being profiled for attachment to a mating connector.

10. The electrical connector of claim 8, comprising four rows of contacts, with two rows being staggered relative to the other rows.

11. The electrical connector of claim 8, wherein one of said end walls extends diagonally between the upper and lower walls, and the opposite wall is discontinuous and has a concave radiused portion.

12. The electrical connector of claim 11, wherein a first fastener member is positioned adjacent to said mating face and at least partially beneath said diagonal wall.

13. The electrical connector of claim 12, wherein a second fastener member is positioned adjacent to said concave radiused portion.

14. The electrical connector of claim 8, wherein said shroud is a shielding member.

15. An electrical connector having a housing body and a plurality of electrical contacts, said connector further comprising a front shroud portion extending forwardly from a front face of said connector, said shroud including an upper and lower elongate wall extending transverse to said front face and a diagonal wall extending between the upper and lower walls, a fastener member positioned adjacent to said mating face and at least partially beneath said diagonal wall, and a discontinuous wall opposite said diagonal wall having a concave radiused portion with a second fastener member positioned adjacent to said concave radiused portion.

16. The electrical connector of claim 15, further comprising a plurality of rows of electrical contacts, said rows being generally staggered to conform within said front shroud portion.

17. The electrical connector of claim 16, comprising four rows of contacts, with two rows being staggered relative to the other rows.

18. The electrical connector of claim 15, wherein said shroud is a shielding member.

19. The electrical connector of claim 15, wherein said connector is a plug connector and is profiled for interconnection to twisted pair conductors of a multiconductor cable.

20. The electrical connector of claim 19, further comprising a mating receptacle connector forming a connection assembly, said receptacle connector having a complementary shielding shroud as said plug connector, and complementary first and second fastener members.

* * * * *